US009407041B2

(12) United States Patent
Lirong et al.

(10) Patent No.: US 9,407,041 B2
(45) Date of Patent: Aug. 2, 2016

(54) ANTI-DISENGAGING MECHANISM OF CABLE CONNECTOR

(71) Applicant: Fu Zhou Liu Fang Mechanical and Electrical Co., Ltd., Cang Shan Fuzhou (CN)

(72) Inventors: Jiang Lirong, Fuzhou (CN); Liang Chen, Los Gatos, CA (US); Yongjun Zheng, Fuzhou (CN); Jie Mo, Cang Shan Fuzhou (CN)

(73) Assignee: Fu Zhou Liu Fang Mechanical and Electrical Co., Ltd., Fuzhou (CN)

( * ) Notice: Subject to any disclaimer, the term of this patent is extended or adjusted under 35 U.S.C. 154(b) by 0 days.

(21) Appl. No.: 14/411,076

(22) PCT Filed: Apr. 3, 2014

(86) PCT No.: PCT/CN2014/074698
§ 371 (c)(1),
(2) Date: Dec. 23, 2014

(87) PCT Pub. No.: WO2015/074364
PCT Pub. Date: May 28, 2015

(65) Prior Publication Data

US 2015/0311634 A1 Oct. 29, 2015

(30) Foreign Application Priority Data

Nov. 21, 2013 (CN) ..... 2013 1 0586883

(51) Int. Cl.
*H01R 13/625* (2006.01)
*H01R 13/639* (2006.01)
*H01R 43/26* (2006.01)
*H01R 13/623* (2006.01)

(52) U.S. Cl.
CPC ..... *H01R 13/639* (2013.01); *H01R 13/6392* (2013.01); *H01R 43/26* (2013.01); *H01R 13/623* (2013.01)

(58) Field of Classification Search
CPC ..... H01R 13/20; H01R 2103/00; H01R 13/6392; H01R 13/639; H01R 13/6395
USPC ..... 439/346
See application file for complete search history.

(56) References Cited

U.S. PATENT DOCUMENTS 4,061,409 A * 12/1977 Bealmear ..... H01R 13/20 439/346
4,971,571 A * 11/1990 Puerner ..... H01R 13/627 439/346
5,082,450 A * 1/1992 Warren, Sr. ..... H01R 13/6395 439/102

(Continued)

*Primary Examiner* — Abdullah Riyami
*Assistant Examiner* — Vladimir Imas
(74) *Attorney, Agent, or Firm* — Douglas L Weller

(57) ABSTRACT

An anti-disengaging mechanism of a cable connector includes a power connector having a jack opening. The power connector also has a metal electrode and a ring buckle located within the jack opening. A plug has a plug pin. When the plug pin is inserted into the jack opening, the ring buckle surrounds the plug pin. A longitudinal sliding pushrod is set in the power connector so that when the longitudinal sliding pushrod is in a first position, the longitudinal sliding pushrod tilts the ring buckle so as to lock the plug pin in the jack opening. When the longitudinal sliding pushrod is in a second position, the ring buckle releases the plug pin.

17 Claims, 6 Drawing Sheets

(56) References Cited

U.S. PATENT DOCUMENTS 5,316,493 A * 5/1994 Sowers ..... H01R 13/443 439/148
5,336,103 A * 8/1994 Herboldsheimer .. H01R 13/622 439/265
8,123,546 B2 * 2/2012 Suzuki ..... H01R 13/62 439/157
8,152,554 B2 * 4/2012 Chapel ..... H01R 13/639 439/346
8,439,697 B2 * 5/2013 Vass ..... H01R 13/6395 439/270
2005/0101169 A1 * 5/2005 Ratcliffe ..... H01R 13/639 439/106
2010/0144187 A1 * 6/2010 Chapel ..... H01R 43/26 439/357

* cited by examiner

Section A-A

Section B-B

Section C-C

Section D-D

ANTI-DISENGAGING MECHANISM OF CABLE CONNECTOR

This application claims priority to PCT Application No. PCT/CN2014/074698 filed on Apr. 3, 2014, which claims priority to China Application No. CN201310586883.4 filed Nov. 21, 2013, which are incorporated in their entirety herein by reference.

FIELD OF THE INVENTION

The present application relates to an anti-disengaging mechanism for a cable connection.

BACKGROUND OF THE INVENTION

A power plug is a power transfer device that connects electric equipment to a power source. A sudden outage can cause serious loss of life and property when power is supplied to important equipment such as a data center requiring continuous power supply, a medical apparatus or instruments in an operating room, etc. Therefore, there is a need for a safe, reliable, simple and effective power source connection. If a power plug loosens or drops out when shaken or collided by external force, this will lead to poor contact or no contact and result in a power outage.

SUMMARY OF THE INVENTION

Here is described an anti-disengaging mechanism for a cable connection that can avoid a plug loosening or dropping out from a power socket or a power cord connector.

For example, an anti-disengaging mechanism includes a power connector having a jack opening. The power connector also has a metal electrode and a ring buckle located within the jack opening. A plug has a plug pin. When the plug pin is inserted into the jack opening, the ring buckle surrounds the plug pin. A longitudinal sliding pushrod is set in the power connector so that when the longitudinal sliding pushrod is in a first position, the longitudinal sliding pushrod tilts the ring buckle so as to lock the plug pin in the jack opening. When the longitudinal sliding pushrod is in a second position, the ring buckle releases the plug pin. A toggling mechanism is also set in the power connector. The toggling mechanism is used to drive the longitudinal sliding pushrod to slide between the first position and the second position. A first portion of the ring buckle is within a supporting groove inside the power connector. A second portion of the ring buckle is inserted into a driving groove of the longitudinal sliding pushrod. The longitudinal sliding pushrod is connected to the toggling mechanism. A toggle of the toggling mechanism protrudes from a shell of the power connector.

For example, the plug includes housing that covers a front of the power connector when the plug pin is inserted into the jack opening.

For example, the longitudinal sliding pushrod includes a chute, the toggling mechanism includes a latitudinal sliding plate and a guide pin under the latitudinal sliding plate is engaged in the chute of longitudinal sliding pushrod.

For example, the toggling mechanism includes a latitudinal sliding plate, the latitudinal sliding plate includes a chute, and a guide pin on longitudinal sliding pushrod which is engaged within the chute of the toggling mechanism.

For example, the chute is an arc-shaped groove that inclines to a longitudinal direction.

There can be beneficial effects of the above-described implementation. For example, the anti-disengaging mechanism adopts a simple ring buckle and applies the friction between the ring buckle and the plug pin to achieve the anti-disengaging goal. This can solve the outage problem for the poor contact or no contact reason when a plug is shaken or collided by external force that might cause a plug to loosen or drop out from a power socket or a power cord connector.

The technical solutions in various embodiments are described below in combination with the accompanying drawings.

Figure 1:
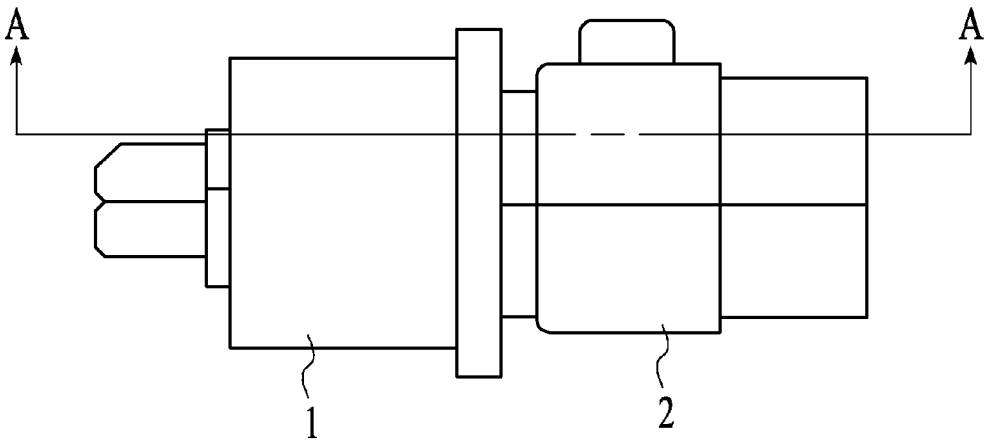
FIG. 1 is a front elevation view of an implementation of the present invention in the lock condition.
Figure 2:
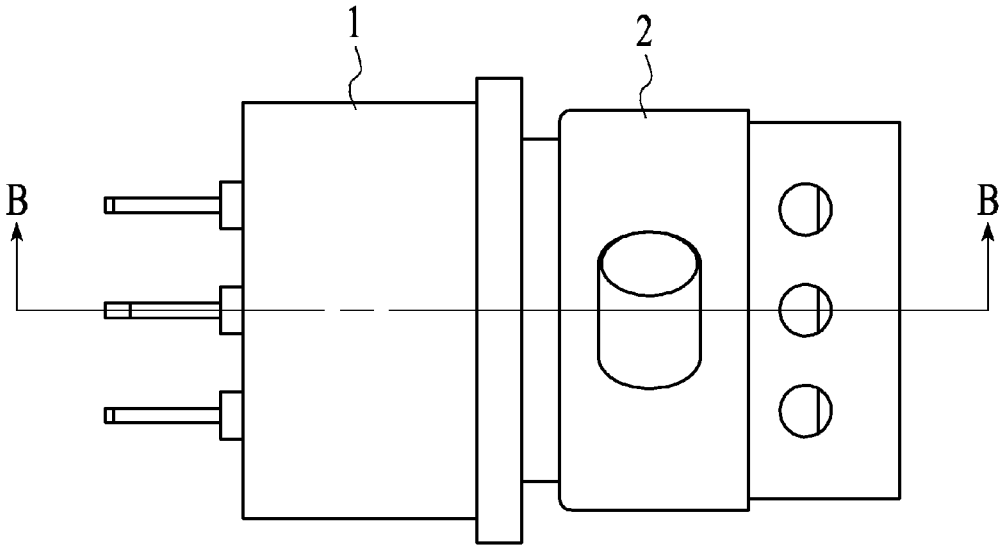
FIG. 2 is a top elevation view of an implementation of the present invention in the lock condition.
Figure 3:
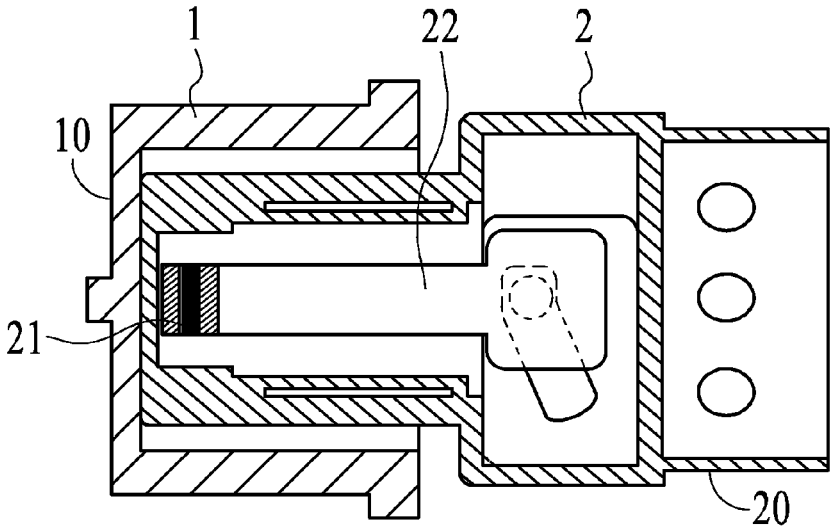
FIG. 3 is a sectional view along the line A-A of FIG. 1.

In these drawings, the reference numerals are as following: 1—Plug, 10—Housing of plug, 11—Plug Pin, 2—Power connector that is a power socket connector or a power cord connector, 20—Shell of power socket or power cord connector, 21—Ring buckle, 22—Longitudinal sliding pushrod, 23—Toggling mechanism, 24—Metal electrode.

DETAILED DESCRIPTION

FIG. 1, FIG. 2, FIG. 3, FIG. 4, FIG. 5, FIG. 6, FIG. 7 and FIG. 8 show various views of an anti-disengaging mechanism of a cable connector. A power connector 2 has at least two jack openings. For example, power connector 2 is either a power socket connector or a power cord connector. A plug 1 matches with the power connector 2. Power connector 2 includes metal electrodes 24, shown in FIG. 4 and FIG. 8, that are installed, one in each jack opening of the power connector 2 to contact plug pins 11, also shown in FIG. 4 and FIG. 8. Plug pins 11 are part of plug 1.

Figure 9:
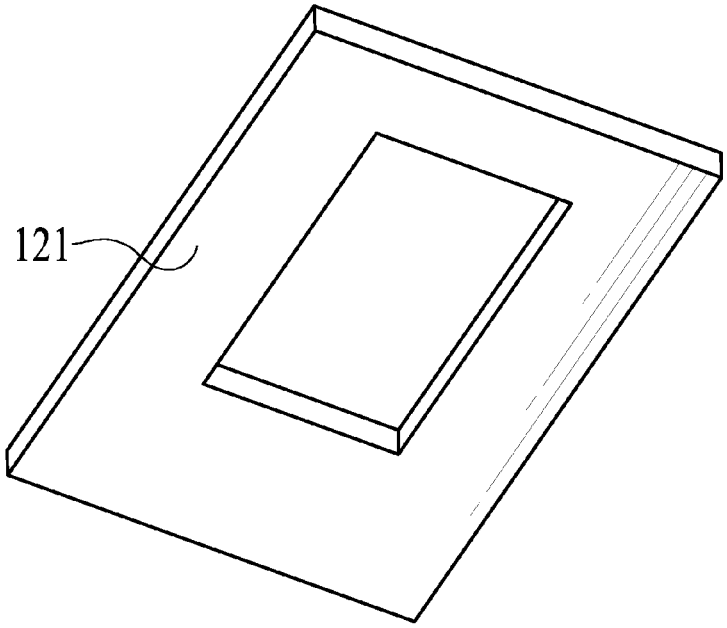
FIG. 9 is a perspective view of the ring buckle.

A ring buckle 21, shown in FIG. 9, is positioned within a jack opening of the power connector 2 so as to surround a plug pin from plug pins 11 when the plug pin is inserted into the jack opening.

Figure 12:
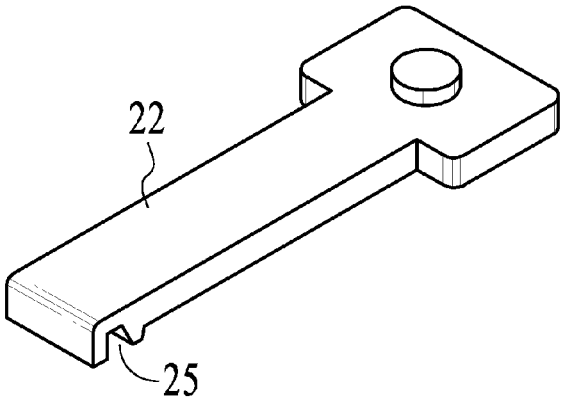
FIG. 12 is a perspective view of another longitudinal sliding pushrod.

A longitudinal sliding pushrod 22, shown in FIG. 12 in the power connector 2 is set in a first position to tilt the ring buckle 21 so as to lock the plug pin from plug pins 11 surrounded by ring buckle 21. Longitudinal sliding pushrod 22 is set in a second position to the ring buckle 21 to release the plug pin from plug pins 11 surrounded by ring buckle 11. A toggling mechanism 23 within the power connector 2 is used to drive longitudinal sliding pushrod 22 to slide forward to the first position and backward to the second position.

Figure 4:
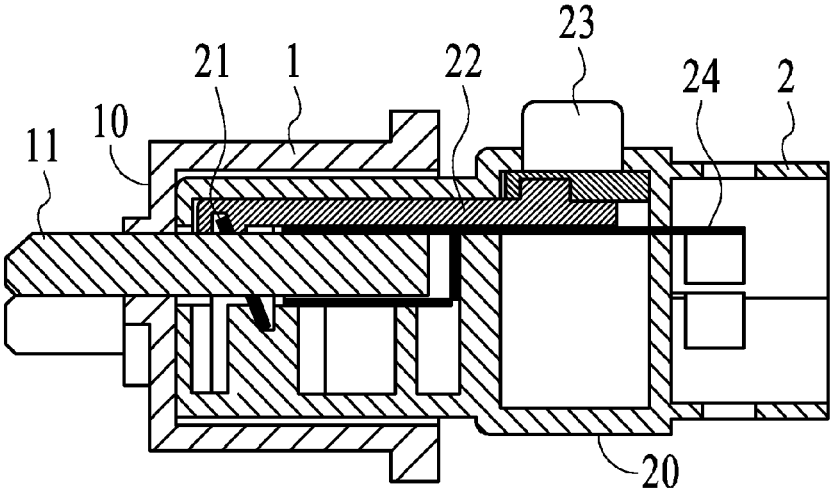
FIG. 4 is a sectional view along the line B-B of FIG. 2.
Figure 5:
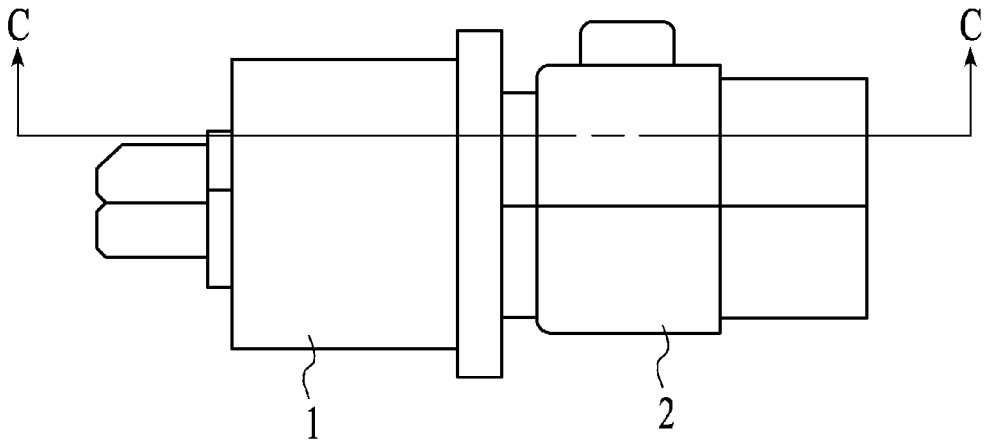
FIG. 5 is a front elevation view of an implementation of the present invention in the release condition.
Figure 6:
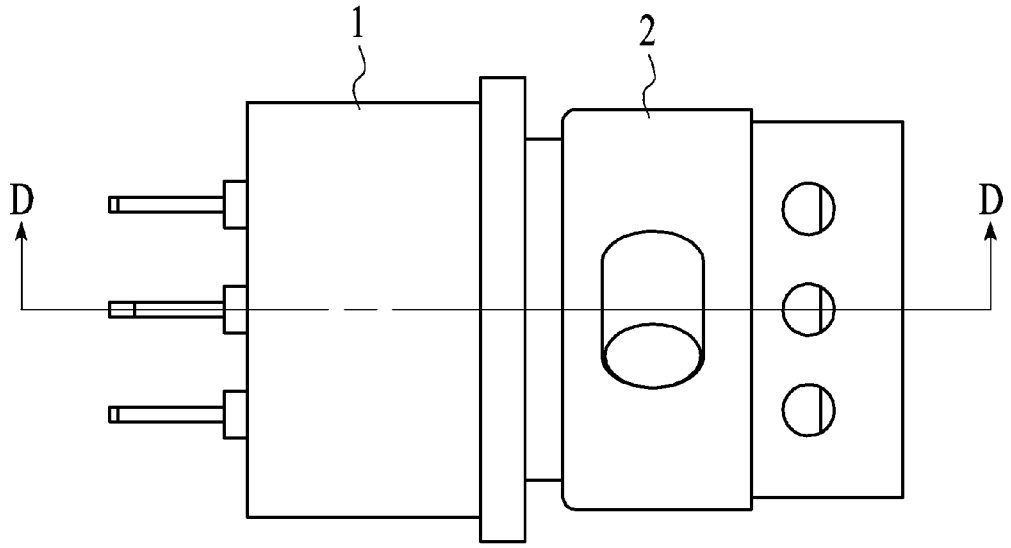
FIG. 6 is a top elevation view of an implementation of the present invention in the release condition.
Figure 7:
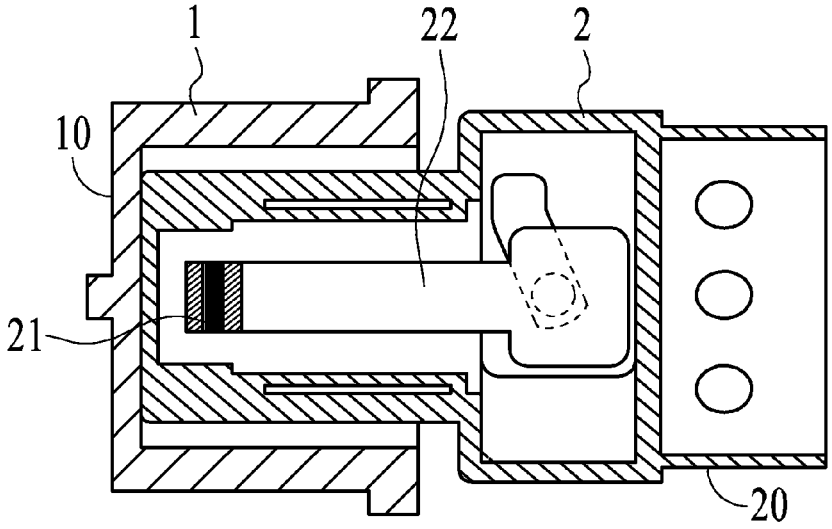
FIG. 7 is a sectional view along the line C-C of FIG. 5.
Figure 8:
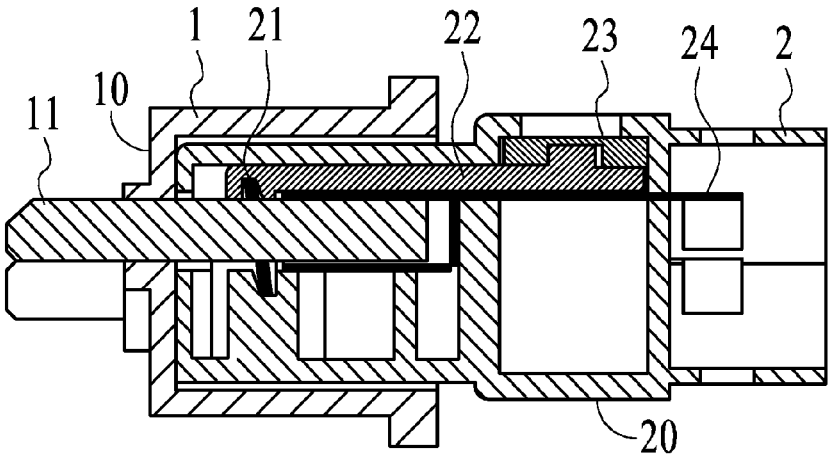
FIG. 8 is a sectional view along the line D-D of FIG. 6.

A bottom of the ring buckle 21 is stuck into the supporting groove that is inside the power connector 2, as shown in FIG. 4. A top of the ring buckle 21 is inserted into a driving groove 25 (shown in FIG. 12) that is under a front of longitudinal sliding pushrod 22. A rear of the longitudinal sliding pushrod 22 is connected to the toggling mechanism 23 whose toggle protrudes from a shell 20 of the power connector.

A housing 10 of a front end of the plug 1 covers a front of the power connector 2 when plug pins 11 of plug 1 are inserted into the jack openings within power connector 2.

Figure 13:
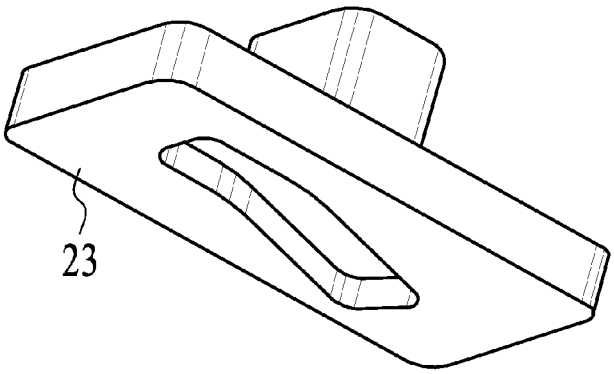
FIG. 13 is a perspective view of another toggling mechanism that matches the longitudinal sliding pushrod of FIG. 12.

Longitudinal sliding pushrod 22 and the corresponding toggling mechanism 23 are shown in FIG. 12 and FIG. 13. The toggling mechanism 23 comprises a latitudinal sliding plate that is inside the power connector 2. A chute is under the latitudinal sliding plate. A guide pin is located on the upper side of the rear of longitudinal sliding pushrod 22 that cooperates with the chute of toggling mechanism 23.

Figure 10:
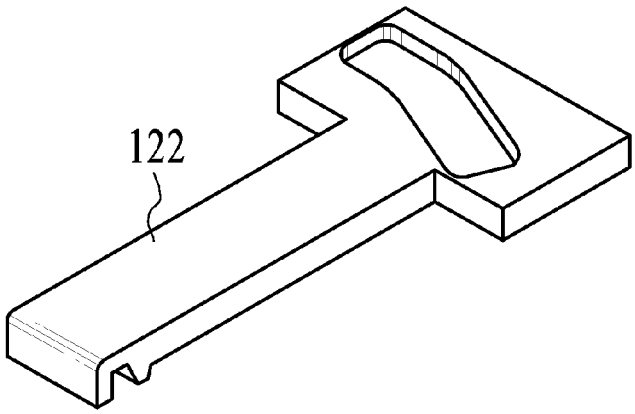
FIG. 10 is a perspective view of one longitudinal sliding pushrod.
Figure 11:
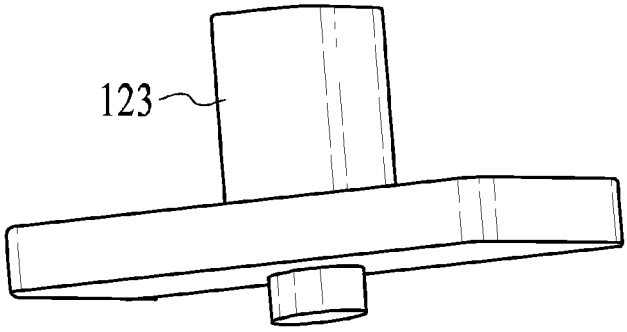
FIG. 11 is a perspective view of one toggling mechanism that matches the longitudinal sliding pushrod of FIG. 10.

In an alternate implementation, a longitudinal sliding pushrod 122 and a corresponding toggling mechanism 123 are shown in FIG. 10 and FIG. 11. There is a chute on the upper side of the rear of longitudinal sliding pushrod 122. The toggling mechanism 123 comprises a latitudinal sliding plate that is inside the power connector 12. A guide pin under the latitudinal sliding plate cooperates with the chute of longitudinal sliding pushrod 122.

For example, the chute is an arc-shaped groove that inclines to the longitudinal direction.

For the longitudinal sliding pushrod 22 shown in FIG. 12 and the toggling mechanism 23 shown in FIG. 13, for example, the chute of toggling mechanism 23 moves to one end when the toggle is flipped to one side. The longitudinal sliding pushrod 22 slides to the plug 1 for its guide pin driven by the chute, which pushes the ring buckle 21 to tilt. This is the first position illustrated by FIG. 1, FIG. 2, FIG. 3 and FIG. 4. With the ring buckle 21 tilted, the top and bottom edges of the hole in the ring buckle 21 are in contact with the plug pin 11. This creates friction to keep the plug 1 engaged with the power connector 2.

When the chute of toggling mechanism 23 moves to the other end as the toggle is flipped to the other side, the longitudinal sliding pushrod 22 concurrently slides away from the plug 1 for its guide pin driven by the chute. This pulls back the ring buckle 21 into the second position. In the second position, the ring buckle 21 is reset so that the top and bottom edges of the hole in the ring buckle 21 have no contact with the one of the plug pin 11. This allows the plug 1 to be pulled out from the power connector 2.

The above description of the disclosed embodiment enables the person skilled in the art to practice and use the application. Various modifications to these embodiments may be obvious to the person skilled in the art. The general principle defined therein may be implemented in other embodiments without departing from the spirit and scope of the application. Thus, the application is not limited to these embodiments illustrated herein, but conforms to a broadest scope consistent with the principle and novel features disclosed herein.

The invention claimed is:

1. An anti-disengaging mechanism for a cable connection, comprising:

a power connector having a metal electrode and a ring buckle located within a jack opening; and a plug having a plug pin;

wherein when the plug pin is inserted into the jack opening, the ring buckle surrounds the plug pin;

wherein a longitudinal sliding pushrod is set in the power connector so that when the longitudinal sliding pushrod is in a first position, the longitudinal sliding pushrod tilts the ring buckle so as to lock the plug pin in the jack opening and when the longitudinal sliding pushrod is in a second position, the ring buckle releases the plug pin;

wherein a toggling mechanism is also set in the power connector, the toggling mechanism being used to drive the longitudinal sliding pushrod to slide between the first position and the second position, wherein the toggling mechanism includes a latitudinal sliding plate, the latitudinal sliding plate sliding in a direction substantially perpendicular to a direction the longitudinal sliding pushrod slides between the first position and the second position, wherein when the latitudinal sliding plates slides into a locking position, this places the longitudinal sliding pushrod in the first position, and when the latitudinal sliding plates slides into an opening position, this places the longitudinal sliding pushrod in the second position; and, wherein a first portion of the ring buckle is within a supporting groove inside the power connector, while a second portion of the ring buckle is inserted into a driving groove of the longitudinal sliding pushrod, the longitudinal sliding pushrod being connected to the toggling mechanism, a toggle of the toggling mechanism protruding from a shell of the power connector.

2. The anti-disengaging mechanism according to claim 1, wherein the plug includes housing that covers a front of the power connector when the plug pin is inserted into the jack opening.

3. The anti-disengaging mechanism according to claim 1, wherein the longitudinal sliding pushrod includes a chute, wherein a guide pin under the latitudinal sliding plate is engaged in the chute of longitudinal sliding pushrod.

4. The anti-disengaging mechanism according to claim 3, wherein the chute is an arc-shaped groove that inclines to a longitudinal direction.

5. The anti-disengaging mechanism according to claim 1, wherein the latitudinal sliding plate includes a chute, and wherein a guide pin on the longitudinal sliding pushrod is engaged within the chute of the toggling mechanism.

6. The anti-disengaging mechanism according to claim 5, wherein the chute is an arc-shaped groove that inclines to a longitudinal direction.

7. A power connector comprising:

a metal electrode located within a jack opening;

a ring buckle located within the jack opening;

a longitudinal sliding pushrod arranged so that when a plug pin of a plug is within the jack opening and the longitudinal sliding pushrod is in a first position, the longitudinal sliding pushrod tilts the ring buckle so as to lock the plug pin in the jack opening and when the longitudinal sliding pushrod is in a second position, the ring buckle releases the plug pin; and, a toggling mechanism, the toggling mechanism being used to drive the longitudinal sliding pushrod to slide between the first position and the second position, wherein the toggling mechanism includes a latitudinal sliding plate, the latitudinal sliding plate sliding in a direction substantially perpendicular to a direction the longitudinal sliding pushrod slides between the first position and the second position, wherein when the latitudinal sliding plates slides into a locking position, this places the longitudinal sliding pushrod in the first position, and when the latitudinal sliding plates slides into an opening position, this places the longitudinal sliding pushrod in the second position.

8. A power connector as in claim 7, wherein a first portion of the ring buckle is within a supporting groove inside the power connector, while a second portion of the ring buckle is inserted into a driving groove of the longitudinal sliding pushrod, the longitudinal sliding pushrod being connected to the toggling mechanism, a toggle of the toggling mechanism protruding from a shell of the power connector.

9. A power connector as in claim 8, wherein the longitudinal sliding pushrod includes a chute, wherein a guide pin under the latitudinal sliding plate is engaged in the chute of longitudinal sliding pushrod.

10. A power connector as in claim 9, wherein the chute is an arc-shaped groove that inclines to a longitudinal direction.

11. A power connector as in claim 8 wherein the latitudinal sliding plate includes a chute, and wherein a guide pin on longitudinal sliding pushrod is engaged within the chute of the toggling mechanism.

12. A power connector as in claim 11, wherein the chute is an arc-shaped groove that inclines to a longitudinal direction.

13. A power connector as in claim 7, wherein the power connector is a power socket connector or a power cord connector.

14. A power connector as in claim 7, wherein the plug includes housing that covers a front of the power connector when the plug pin is inserted into the jack opening.

15. A method for connecting a plug to a power connector, the method comprising placing a plug pin of a plug into a jack opening of a power connector so that the plug pin is electrically connected to a metal electrode located within the jack opening;

sliding a longitudinal sliding pushrod into a first position, the longitudinal sliding pushrod tilting a ring buckle surrounding the plug pin into a position so as to lock the plug pin in the jack opening;

sliding the longitudinal sliding pushrod into a second position so that the ring buckle releases the plug pin; and, using a toggling mechanism to drive the longitudinal sliding pushrod to slide between the first position and the second position, wherein the toggling mechanism includes a latitudinal sliding plate, the latitudinal sliding plate sliding in a direction substantially perpendicular to a direction the longitudinal sliding pushrod slides between the first position and the second position, wherein when the latitudinal sliding plates slides into a locking position, this places the longitudinal sliding pushrod in the first position, and when the latitudinal sliding plates slides into an opening position, this places the longitudinal sliding pushrod in the second position.

16. A method as in claim 15, wherein the power connector is a power socket connector or a power cord connector.

17. A method as in claim 15, additionally comprising:

covering a front of the power connector with a housing when the plug pin is inserted into the jack opening.

* * * * *